United States Patent [19]

Regan

[11] 4,180,048

[45] Dec. 25, 1979

[54] CUTTING WHEEL

[76] Inventor: Barrie F. Regan, 2260 Redington Rd., Hillsborough, Calif. 94010

[21] Appl. No.: 914,627

[22] Filed: Jun. 12, 1978

[51] Int. Cl.[2] ..... B28D 1/04

[52] U.S. Cl. ..... 125/15; 51/206 R

[58] Field of Search ..... 125/15, 18; 51/206 R, 51/209 R

[56] References Cited

U.S. PATENT DOCUMENTS

| | | | |
|---|---|---|---|
| 3,553,905 | 1/1971 | Lemelson | 125/15 |
| 3,691,707 | 9/1972 | Vonarx | 125/15 |
| 3,886,925 | 6/1975 | Regan | 125/15 |

*Primary Examiner*—Harold D. Whitehead

*Attorney, Agent, or Firm*—Limbach, Limbach & Sutton

[57] ABSTRACT

An improved cutting wheel for dicing semiconductor wafers is described. The cutting blade of the wheel is a thin disc consisting of finely divided abrasive particles embedded in a nickel matrix. The surface of the nickel is overlaid with a thin layer of chromium which is electrolytically deposited on it. The cutting speed and useful life of the wheel are both increased by the presence of the chromium overlay.

1 Claim, 2 Drawing Figures

CUTTING WHEEL

BACKGROUND OF THE INVENTION

Semiconductor wafers such as silicon wafers are diced to produce small semiconductor chips which are used in the assembly of semiconductor devices. The dicing is accomplished by scribing the semiconductor wafer with two sets of parallel scribe lines which are perpendicular to each other and mark out of a plurality of square or rectangular chips on the wafer surface. The wafer is then broken along the scribe lines in order to produce the desired chips. Cutting wheels used for scribing semiconductor wafers are described in U.S. Pat. Nos. 3,961,707 and 3,886,925. These wheels have thin cutting discs which lie along the periphery of the wheel and which consist of finely divided abrasive particles embedded in a nickel matrix.

In the use of cutting wheels of this type it has been found that siliceous materials of which the semiconductor wafers are formed adhere to the nickel matrix. As a cut is made the siliceous debris from the cut adheres to the nickel matrix with the result that the frictional load on the wheel during cutting is increased with the result that the cutting rate is reduced and with the further result that the wheel life is shortened.

BRIEF DESCRIPTION OF THE INVENTION

Wheels of the type described above are used in dicing a variety of materials, generally of siliceous character, which are used in the assembly of semiconductor devices including but not limited to quartz, sapphire, garnet, alumina and glass. The debris formed in cutting all of these materials adheres to the nickel matrix of the cutting disc to such an extent that the load on the wheel during the making of a cut is increased and the life of the wheel is shortened. It has now been found that if a very thin layer of chromium is electrolitically deposited on the nickel matrix in which the abrasive particles are embedded adherence of the siliceous debris to the cutting disc is markedly decreased with the result that cutting speed is greatly increased, for instance five fold in the case of glass and the cutting life of the wheel is extended as much as ten times the life it would have in a given cutting service absent the chromium layer.

DETAILED DESCRIPTION OF THE INVENTION

Figure 1:
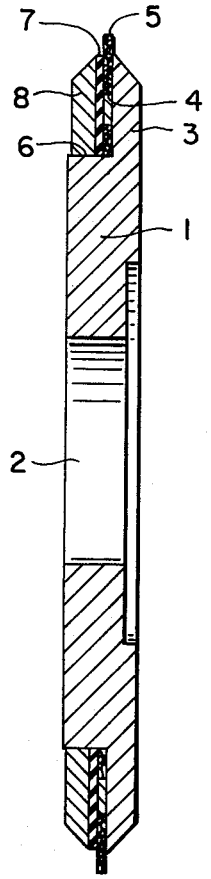

FIG. 1. of the appended drawing is a cross-section of the cutting wheel of the invention.

Figure 2:
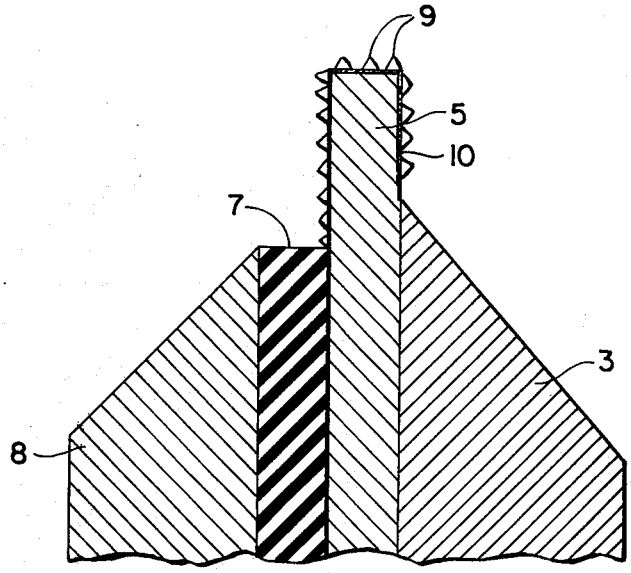

FIG. 2 of the drawing is an expanded view of a cross-section of the cutting blade.

Referring now to FIG. 1 of the drawings, the wheel consists of hub 1 having a circular aperture 2 which is fitted over a driving axle. Flange 3 extends outward from the periphery of the hub. A thin sheet 4 of a matrix of nickel in which finely divided abrasive particles are embedded lies along flange 3. The nickel matrix containing finely divided particles such as diamond particles is deposited on flange 3 in a manner described in technical brochure 11-644312 A-357 published by International Nickel Company, Inc. N.Y. The nickel solutions described in the brochure have finely divided abrasive particles suspended in them. It is preferred that the nickel solutions and the resulting metallic nickel deposited be of very high purity since high purity nickel appears to be more resistant to the mechanical stresses imposed on the cutting disc at high rotational velocities.

The abrasive particles are laid down with and emeshed in the nickel plate. At the time when the nickel-abrasive layer is laid down on the flange the flange extends the full length of the nickel layer 4 shown including the cutting disc 5 which extends beyond the flange in the drawing. After the nickel layer has been laid down the outer periphery of the flange (not shown) is etched away exposing the periphery of the electroplate to a depth in the range about 0.001 to 0.200 inch and this exposed periphery constitutes the cutting disc 5. After the deposition of the nickel-abrasive layer is completed a thin layer 7 of an elastomer such as a silicon rubber is laid down on the surface of the nickel matrix. A sealing ring 8 is then fitted over hub shoulder 6 and pressed into contact with the elastomer.

After the cutting wheel is formed to the extent described above hub 1, flange 3 and sealing ring 8 are masked. A direct current source is contacted with the hub aperture 2 and the wheel is immersed in a plating bath. Prior to immersion cutting disc 5 is washed with caustic, rinsed and dipped into an acid activator which may be sodium bisulfate. The plating bath consists of chromic acid at a concentration of 33 oz. per gallon and sulfuric acid at a concentration of 0.3 ozs. per gallon. A lead anode is inserted in the plating bath and the cutting wheel acts as the cathode. The cutting wheel is about two inches in diameter and the unmasked blade to be plated extends inwardly from the periphery about 30 mils. Direct current at 3 to 6 volts is applied and the wheel is exposed to plating action for a period of 5 to 50 ampere minutes. The cutting wheel is then removed from the bath, rinsed and dried. The wheel is then ready for use.

The cutting wheel is exposed to plating action for a time sufficient to lay down a chromium plate having a thickness at least one-fiftieth of the diameter of the abrasive particles embedded in the nickel matrix. Suitable abrasive particles include particles of diamond, alumina, carborundum, boron nitride, tungsten nitride and the like, but the thickness of the chromium layer is based on the particle size of the abrasive, irrespective of its chemical composition. The thickness of the chromium plate laid down varies with the diameter of the abrasive particles in the nickel matrix. These particles vary in size depending upon the material to be scribed by the wheel, for example when the material is glass or quartz the abrasive particles are in the range 15 to 30 microns in diameter and when the material to be scribed is a silicon wafer the particles are in the range 4 to 8 microns in diameter. The thickness of the chromium layer is preferably in the range one-fifth to one-tenth the diameter of the abrasive particles. When the nickel-abrasive layer is electroformed on the flange the surface of the nickel-abrasive matrix is such that 40 to 60% of the diameter of the exterior abrasive particles protrudes from the surface of the nickel metal. When the thickness of the chromium layer is held to the range one-fifth to one-fiftieth of the diameter of the abrasive particles, a chromium layer is formed which not only is free from essentially all adherence of the debris produced during the cutting but which also hardens and strengthens the bond between the abrasive particles and the metal in which they are embedded.

The following table provides comparative data showing the effectiveness of the chromium plated cutting disc as compared to the identical disc without the chromium plate. The abrasive particles in both wheels are diamond particles of diameter range from 15 to 30 microns. The chromium plate was 2 microns in thickness. The cuts were made to a depth of 0.025 inches and the rotational speed of the wheels was 25,000 rpm.

| | Wheel Without Chromium Plate | Wheel With Chromium Plate |
|---|---|---|
| Cutting Speed | 0.2"/Sec | 2.0–2.5"/Sec |
| Wheel Life Total Inches Cut | 40–50 | 500–2000" |

The chromium layer laid down on the nickel matrix must be an electrochemically deposited layer. Other methods for laying down chromium layers such as flame spraying and by use of a plasma arc gun have been described but these methods cannot be used in producing the wheel of the present invention. These methods are characterized by the employment of high temperatures and if it is attempted to use them to chromium coat the very thin cutting discs of the present cutting wheels the discs are immediately warped and become inoperable. The thin discs cannot withstand high temperature and during the course of their use a water spray is directed at the cutting contact to prevent warping due to frictional heat developed during the cutting operation. The water spray holds the temperature of the cutting discs, which range in thickness from about 0.0005 to 0.01 inch, to temperatures below about 150° F., and so prevent warping.

The cutting blades described in detail above are generally referred to as OD (outside diameter) blades and as indicated are used in scribing ceramic wafers to permit breaking of the wafer into chips.

The wafers on which the OD blades are used must be sliced from a large semiconductor mass. For instance a long single crystal of silicon is sliced into wafers which are then scribed and broken into chips. The cutting blades used in slicing wafers from a larger mass of material are generally ID (inner diameter) blades. These blades are made from circular sheets of high tensile stainless steel. The circular sheets are commonly 16 to 21 inches in diameter and have a circular hole 7 to 9 inches in diameter centered in the sheet. A nickel matrix in which finely divided abrasive particles are embedded is electroformed along the margin of the interior hole and constitutes the cutting blade. The ID blades may then be electrolytically coated with a thin chromium layer in the same manner and with the same improvements in cutting speed and cutting life as those above described for the OD blades.

I claim:

1. In a cutting blade for use in cutting siliceous materials consisting essentially of an electroformed matrix of abrasive particles in a nickel binder, having a blade thickness in the range about 0.0005 to 0.01 inch, having abrasive particles ranging in diameter from 4 to 30 microns and having a surface such that from 40 to 60 percent of the diameter of the exterior abrasive particles protrude from the surface of the nickel matrix, the improvement which comprises a thin layer of electrochemically deposited chromium on the surface of the nickel matrix ranging in thickness from 1/5 to 1/50 the diameter of the abrasive particles.

* * * * *